United States Patent [19]

Christopher

[11] 4,221,334

[45] Sep. 9, 1980

[54] ADJUSTABLE NOZZLE FOR CROP SPRAYING

[76] Inventor: Gilman O. Christopher, 924 W. 11th Pl., Mesa, Ariz. 85201

[21] Appl. No.: 31,191

[22] Filed: Apr. 18, 1979

[51] Int. Cl.[3] ..... A62C 31/02

[52] U.S. Cl. ..... 239/394; 239/112; 239/171; 239/523

[58] Field of Search ..... 239/394, 390, 171, 521, 239/523, 112, 106, 520

[56] References Cited

U.S. PATENT DOCUMENTS

| | | | |
|---|---|---|---|
| 1,764,570 | 6/1930 | Lohman | 239/523 X |
| 2,388,093 | 10/1945 | Smith | 239/394 |
| 3,179,341 | 4/1965 | Plos et al. | 239/112 X |
| 3,596,835 | 8/1971 | Smith | 239/394 |

*Primary Examiner*—Robert B. Reeves
*Assistant Examiner*—Gene A. Church
*Attorney, Agent, or Firm*—H. Gordon Shields

[57] ABSTRACT

Nozzle apparatus includes a head having a plurality of holes for sequential alignment with a delivery port and a cleanout hole also sequentially aligned with a delivery port, and a curved surface extends about the head for producing a fan-shaped spray when a hole is aligned with the delivery port and a fluid is pumped through the delivery port.

10 Claims, 6 Drawing Figures

ADJUSTABLE NOZZLE FOR CROP SPRAYING

BACKGROUND OF THE INVENTION

1. Field of the Invention

This invention relates to spray heads and, more particularly, to spray heads for providing a fan-shaped spray from any one of a plurality of different sized holes.

2. Description of the Prior Art

For the aerial spraying of crops, the prior art spray nozzles all deliver a swirling pattern of the spraying liquid. The swirling, conical spray pattern extends downwardly from each nozzle, and a plurality of nozzles are generally aligned in a spaced apart relationship so that the swirling spray eventually overlaps to form some type of curtain. The overlapping sprays theoretically form into a curtain type configuration prior to the spray contacting the plants being sprayed. A typical nozzle of the prior art is shown in U.S. Pat. No. 3,596,835.

Another type of nozzle which also provides a conical, swirling type spray is disclosed in U.S. Pat. No. 2,388,093. The nozzles of both U.S. Pat. No. 3,596,835 and U.S. Pat. No. 2,388,093 include a plurality of holes or apertures, each of a different size, for producing different flow rates.

One of the problems with the prior art, swirling or conical type spray pattern, is that several feet are required before the cones of spray actually meet and blend into a solid, even sheet of spray. If the aircraft is not the absolutely correct height above the crops, then the spray pattern will not be relatively solid and an even spraying of the entire crop will not be accomplished.

One solution to the problem of providing a relatively solid, overlapping curtain of spray within a short distance after the spray liquid leaves the aircraft nozzles is to provide a fan-shaped spray pattern. It is known and understood that if a flow or stream of liquid is directed against a curved surface, a single curtain or fan-shaped spray of the liquid will result. Different apparatus have been developed in the prior art to provide a relatively flat spray, such as shown by U.S. Pat. No. 3,826,430. The apparatus of U.S. Pat. No. 3,826,430 is not, of course, directly related to an aircraft crop spraying system, but it does disclose a diffusing face adjacent an orifice through which a stream of liquid (water) flows. Another such apparatus which discloses a relatively flat, fan-shaped type of spray is shown in U.S. Pat. No. 1,288,122 and also in U.S. Pat. No. 580,251. However, none of the above-described patents relate to, or could be used, for aerial crop spraying. Moreover, none of the apparatus disclose the interchangeability of holes to provide a varied spray, depending on the size of the hole or orifice lined up with the stream of material to be sprayed.

The apparatus of the present invention provides both a curved surface for providing a fan-shaped spray of material, and a variable spray head having various sized orifices, each of which may be selectively aligned with a single port through which the stream of liquid flows for spraying onto a crop.

SUMMARY OF THE INVENTION

The crop spraying nozzle apparatus disclosed and claimed herein includes a continuously curved surface having a plurality of holes aligned with the curved surface for producing a fan-shaped spray of fluid or liquid from any one of a plurality of orifices or holes of different sizes, any of which is individually selectable for varying the quantity of liquid to be sprayed.

Among the objects of the present invention are the following:

To provide new and useful aerial spray apparatus;

to provide new and useful nozzle apparatus for spraying crops;

To provide new and useful spray nozzle apparatus for producing a fan-shaped spray of liquid;

To provide new and useful spray nozzle apparatus having a plurality of delivery orifices for providing variable amounts of liquid to be sprayed; and To provide new and useful spray apparatus having a continuously curved surface against which a stream of liquid flows for providing a fan-shaped spray of the fluid.

DESCRIPTION OF THE PREFERRED EMBODIMENT

Figure 1:
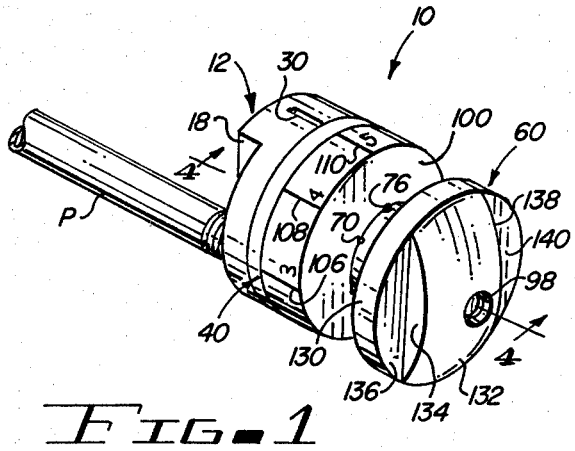
FIG. 1 is a perspective view of the apparatus of the present invention.

FIG. 1 comprises a perspective view of nozzle apparatus 10 of the present invention. The nozzle 10 is shown connected to a pipe or conduit P through which liquid flows through the nozzle apparatus 10. The conduit or pipe P is in turn connected through a shutoff valve to a tank (not shown) which contains the liquid to be sprayed onto crops. Typically, there are a plurality of pipes or conduits P extending from a single manifold which is in turn connected by a valve to the spray tank. An aircraft will generally have a single manifold under each wing, and each manifold will have a plurality of conduits or pipes, such as shown in FIG. 1 and indicated by the letter P, extending from the manifold. Each pipe or conduit terminates in a spray head or nozzle, such as the apparatus 10 of the present invention. When the pilot activates his control valve, fluid flows from the tank through the manifolds, and from the manifolds into the pipes and through the spray heads or nozzles for delivery to the crop being sprayed.

Figure 4:
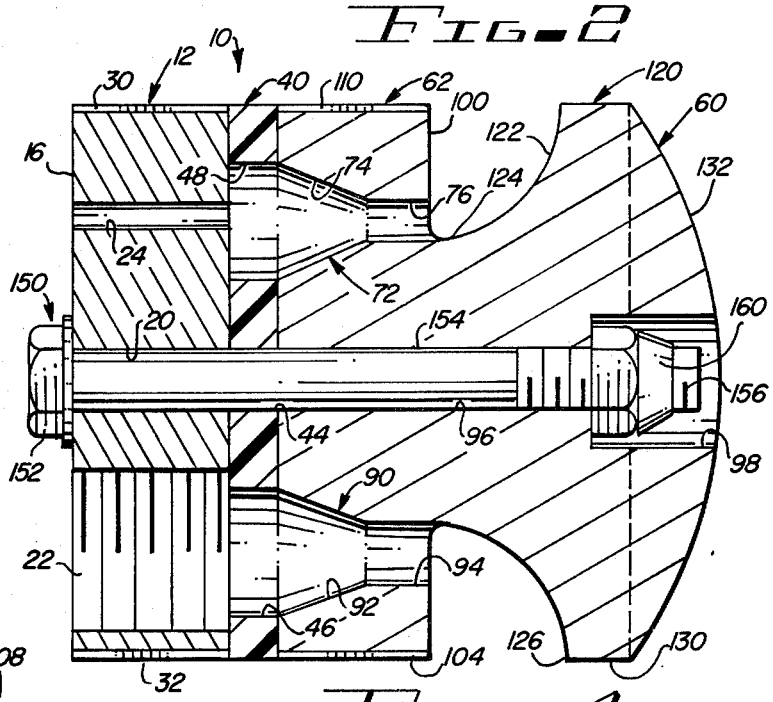
FIG. 4 is a view in partial section of the assembled nozzle apparatus of FIG. 1.

The nozzle apparatus 10 includes three primary components or portions. The components are shown spaced apart from each other in an exploded view comprising FIG. 2. The three primary components or portions include a base 12, a gasket 40, and a spray head 60. FIG. 4, which is a view in partial section of the spray nozzle apparatus 10 of FIG. 1, comprises an assembled view of the spray nozzle apparatus 10, illustrating the various components and their working relationships with respect to each other.

Figure 2:
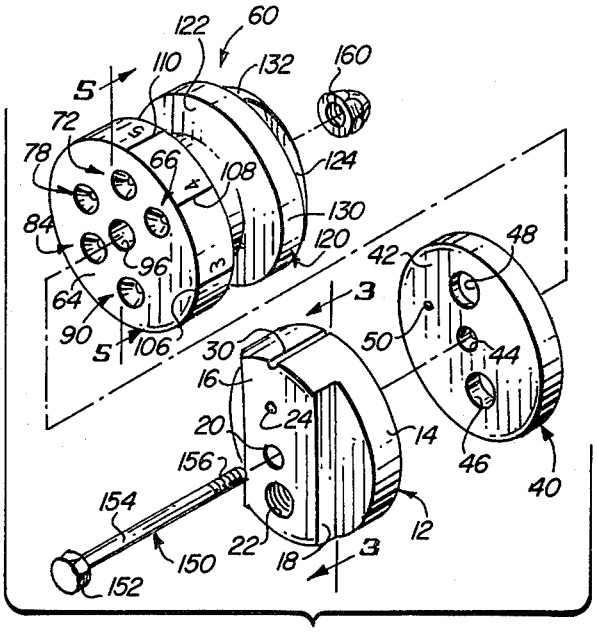
FIG. 2 is an exploded perspective view of the apparatus of FIG. 1 illustrating the various elements which comprise the apparatus.
Figure 3:
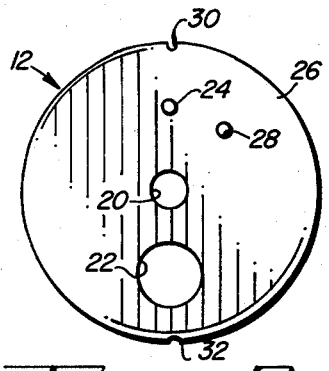
FIG. 3 is a view in partial section of a portion of the apparatus of FIG. 2 taken generally along line 3—3 of FIG. 2.

The base 12 includes a generally cylindrical portion 14, which incluces a pair of parallel faces, such as rear face 16, best shown in FIG. 2, and front face 26, best shown in FIG. 3. FIG. 3 is an end view of the base 12 taken generally along line 3—3 of FIG. 2.

A pair of notches or flats 18 are cut into the cylindrical portion 14 and inwardly from the rear face 16 to provide surfaces on which tools may be secured for threading the base 12 onto the delivery pipe P. The flats 18 accordingly are spaced apart a predetermined distance, in keeping with a prior determination as to the size of wrench, or other tool, to be used to secure the base 12, with the rest of the spray nozzle components secured thereto, to the delivery pipe or conduit P.

Extending axially through the cylindrical portion 14 of the base 12 is a central bore 20. As best shown in FIG. 4, the central bore receives a bolt 150 which secures the three portions of the spray nozzle apparatus 10 together. Extending also axially through the cylindrical portion 14 is a threaded bore or port 22. The threaded bore or port 22 is spaced apart from the central bore 20, and is substantially parallel thereto. The bore 22 is threaded internally to receive the external threads of the pipe P, which is secured thereon.

A third bore or aperture 24 extends also axially through the cylindrical portion 14 of the base 12. The bore or aperture 24 comprises a cleanout hole, and it is aligned with outlet ports on the head 60, as discussed below, for cleanout purposes. The three bores 20, 22, and 24 are generally parallel to each other, but only the central bore 20 is coaxially aligned with respect to the base 12. Each of the three bores 20, 22, and 24 are of different diameters, as is clearly shown in FIG. 3.

FIG. 3, which is an end view of the base 12, showing the front face 26 of the base, also shows a pin 28 extending outwardly from the front face 26. The pin 28 is used to index the gasket 40 to the base 12, and to prevent the gasket from turning when the head 60 is turned to align the port 22 with a desired discharge port of the appropriate size, as discussed below.

For aiding in aligning the discharge ports or discharge nozzles on the head 60 with the base 12, a pair of index notches are used. As shown in FIGS. 1, 2, 3, and 4, a notch 30 extends axially along the top of the cylindrical portion 14 of the base 12. A notch 32 extends axially along the outer periphery of the cylindrical portion 14 of the base 12, diametrically opposite the base 12 from the notch 30. This is best shown in FIGS. 3 and 4.

The gasket 40 is of a generally cylindrical configuration having a rear face 42, shown in FIG. 2, and a substantially parallel front face, not shown. The faces are spaced apart a relatively short distance, the length of which is the appropriate distance needed to allow the gasket 40 to effectively seal the base 12 and the head 60 to prevent leaks therebetween as the spray head 10 is used. Preferably, the gasket 40 is made of appropriate, relatively low cost material, such as polytetrofluoroethylene, marketed commonly under the trademark of "Teflon" by DuPont. The gasket includes three apertures or bores, such as a central bore 44, a lower bore 46, and an upper or cleanout bore 48. The three apertures or bores 44, 46, and 48 extend entirely through the gasket. The bores 44, 46, and 48 align with the bores 20, 22, and 24, respectively of the base 12.

In addition to the three bores discussed in the preceding paragraph, the gasket 40 also includes a relatively short bore or pin hole 50 which extends inwardly from the rear face 42 of the gasket. The pin hole 50 receives the pin 28 to keep the gasket 40 aligned with the base 12. It will be noted that the bores 44, 46, and 48 extend through the gasket 40, between the rear face 42 and the front face, as best shown in FIG. 4. However, the pin hole 50 does not extend entirely through the gasket 40, but rather extends only part way through the gasket 40, inwardly from the rear face 42. Since its purpose is merely to receive the indexing pin 28 to keep the gasket 40 and the base 12 aligned, the bore 50 preferably does not extend entirely through the gasket. The bores 44, 46, and 48 extend through the gasket in order to perform their function, as described above, and as discussed in more detail below.

The spray head 60 includes two portions, a cylindrical base portion 62, and a convex-concave front portion 120.

The cylindrical base portion 62 of the head 60 includes a rear face 64 and a front face 100, both of which faces are substantially parallel to each other. Moreover, the faces 64 and 100 are substantially parallel to the front and rear faces 16 and 26 of the base 12.

Figure 5:
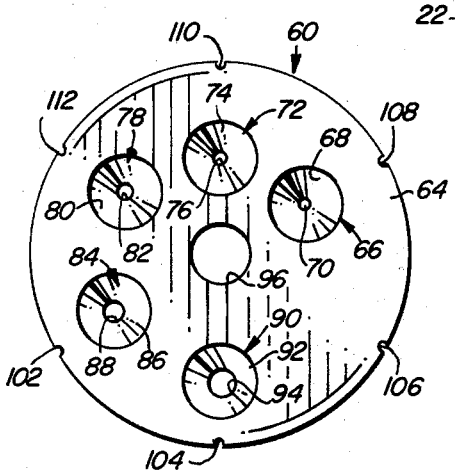
FIG. 5 is an end view of the spray head used in the present invention, taken generally along line 5—5 of FIG. 2.

Five discharge ports or nozzles 66, 72, 78, 84, and 90 are shown extending through the base 62 of the head 60. The five discharge ports or nozzles are best shown in FIGS. 2 and 5, with added details shown in FIGS. 1 and 4. Reference will be made to FIGS. 1, 2, 4, and 5 in the following discussion concerning the discharge points or nozzles and the spray head 60.

The five discharge ports or nozzles 66 . . . 90 are spaced apart from each other and they extend generally axially through the cylindrical base portion 62 of the head 60. The ports or nozzles are identified, primarily in FIGS. 2 and 5, by reference numerals 66, 72, 78, 84, and 90, counterclockwise and in increasing size with respect to each other. Each of the discharge ports or nozzles includes an inwardly tapered portion and a cylindrical portion. The tapered portion of each port or nozzle is substantially the same size. However, the cylindrical portions differ from each other in diameter, which provides a variable output from the spray nozzle apparatus 10, depending on which port is lined up with the threaded bore or port 22 of the base 12. The tapered portions are generally of a conical configuration, extending concavely inwardly from the rear face 64.

As best shown in FIG. 5, the discharge port or nozzle 66 includes a tapered portion 68 and a cylindrical portion 70. The discharge nozzle or port 72 includes a tapered portion 74 and a cylindrical portion 76. The cylindrical portion 76 of the port 72 is slightly larger in diameter than the cylindrical portion 70 of the nozzle or port 66. The nozzle or port 78 includes a tapered portion 80 and a cylindrical portion 82, the latter of which is slightly larger than the cylindrical portion 76 of the port 72. The nozzle 84 includes a tapered portion 86 and a cylindrical portion 88, the latter of which is slightly greater in diameter than the cylindrical portion 82 of the nozzle 78. Finally, the discharge port or nozzle 90 includes a tapered portion 92 and a cylindrical portion 94. The cylindrical portion 94 is, in turn, slightly greater in diameter than that of the cylindrical portion 88 of the nozzle or port 84.

On a graduated scale, the discharge nozzle or port 66 may be referred to as a number 1 nozzle, with the succeeding nozzles or ports generally referred to, successively, as numbers 2, 3, 4, and 5. The latter nozzle is designated by reference number 90, and the intermediate ports or nozzles are designated by their respective reference numerals 72, 78, and 84. The output from the port number 1 is substantially less than the output from the nozzle or port number 5, which has the greatest cylindrical diameter of the five.

It will be noted, particularly with reference to FIG. 4, that the outer or maximum diameter of the conically tapered portions of the nozzles or discharge ports is substantially the same diameter as the diameter of the bores or apertures 46 and 48 of the gasket 40. The respective diameters or sizes of the gasket apertures and the tapered portions are correlated to the size of the discharge pipe P, with reference to its internal diameter, through which the liquid spray flows to the nozzle apparatus 10.

As best shown in FIG. 4, there is a substantial difference between the diameter of the cylindrical bore portion 76, the number 2 port, and the diameter of the cylindrical bore portion 94, the number 5 port. The output of the port or nozzle 90 is accordingly substantially greater than the output of the nozzle or port 72.

As clearly illustrated in FIG. 4, the cleanout hole 24 of the base 12 is aligned with the aperture or hole 48 of the gasket 40 and also with the discharge nozzle or port 72. The relative diameters of the various bores or apertures is also shown in FIG. 4. Since the bore 24 receives only a relatively small diameter wire or pin, for cleanout purposes, it is obvious that the diameter of the bore 24 need not be large.

In conjunction with the discharge nozzles 1, 2, 3, 4, and 5 (reference numerals 66, 72, 78, 84, and 90, respectively), there are six axially extending notches 102, 104, 106, 108, 110, and 112, disposed on the outer periphery of the cylindrical portion 62 of the base 60. As shown in FIGS. 1 and 2, the notches each have a number beside them, to identify which of the discharge nozzles are aligned with the threaded bore or port 22 and accordingly with the supply pipe P (see FIG. 1). The notches 102 . . . 110 are disposed 180° from their respective nozzles or ports to which they are correlated, the discharge nozzles or ports 1 . . . 5 respectively.

The sixth notch 112, as best shown in FIG. 5, is disposed 180°, or diametrically, from a blank portion of the base 62 which does not have a discharge port or nozzle extending therethrough. Accordingly, when the notch 112 is aligned with the notch 30 on the base 12, the threaded bore or port 22 in the pipe P will be aligned only with a blank portion of the base 62 and there will accordingly be no flow or output from the spray nozzle apparatus 10.

The alignment of the notch 30 on the base 12 with the respective notches 102 . . . 112 is best shown in FIG. 1. In FIG. 1, the notch 30 of the base 12 is shown aligned with notch 110 on the head 60. The numeral 5 is shown adjacent the notch 110, to indicate that the largest discharge port, port 90, is aligned with the bore 22 and supply pipe P. This alignment is also illustrated in FIG. 4.

Extending through the head 60 is a central bore 96. The central bore 96 is coaxially aligned with respect to the spray nozzle apparatus 10, and accordingly is aligned with the bores 20 and 44 of the base 12 and the gasket 40, respectively.

The bore 96 includes a counter bore 98 which extends inwardly from a convex or front surface 132 of the concave-convex front portion 120 of the head 60. This is also best shown in FIG. 4.

The bolt 150 extends through the aligned apertures 20, 44, and 96, to secure the three portions of the spray nozzle apparatus together. The bolt 150 includes a head 152, a stem or shank 154, and a threaded outer end portion 156. The threaded outer end portion 156 is shown in FIG. 4 as extending into the counterbore 98, where a self locking nut 160 is shown threadedly engaging the end 156 of the shank 154 of the bolt 150. Thus, the bolt 150 and the nut 160 secure the base 12, the gasket 40, and the head 60 together to comprise the unitary spray nozzle 10.

While a bolt and nut are illustrated and discussed herein as securing together the three portions of the nozzle apparatus 10, it is obvious that a screw extending into a tapped bore, or any other appropriate fastening means may be used. For example, the control bore 20 of the base 12 may simply extend inwardly from the face 26 and may be tapped to receive a threaded shank of a screw extending through the head 60.

With the spray nozzle apparatus 10 secured together, and the pipe P secured to the nozzle apparatus 10, the apparatus 10 is ready to be used, providing a discharge bore or port is aligned with the bore 22 and the pipe P secured therein. For illustrative purposes, particular reference will be made to FIG. 4 and particularly to the discharge port or nozzle 90 (port number 5) which is aligned with the aperture 46 of the gasket 40 and the bore 22 of the base 12 for the following explanation.

Fluid through the pipe P (see FIG. 1) flows through the bore 22 and the bore or aperture 46 of the gasket 40 to the inwardly tapering portion 92 of the discharge nozzle 90 (number 5). The fluid flow is directed inwardly toward the cylindrical portion 94 of the nozzle 90 by the inwardly tapering walls of the bore portion 92. Then the flow is directly outwardly through the cylindrical portion 94. From the cylindrical bore portion 94, the fluid flow impinges directly upon a circular concave face 122 of the concaveconvex front portion 120 of the head 60. The circular concave face 122 extends outwardly from a minimum diameter inner portion 124, which comprises the juncture of the front face 100 of the cylindrical portion 62 of the head 60 with the concave-convex front portion 120 of the head 60. The circular concave face 122 extends outwardly from the juncture 124 in a generally smooth, regular curve to a maximum diameter outer portion 126. The maximum diameter outer portion or area 126 is the juncture of the circular concave face 122 with a second or outer cylindrical portion 130. The cylindrical portion 130 is an outer cylindrical portion, spaced apart from the cylindrical portion 62 of the head 60. The front or convex outer portion or surface 132 extends forwardly from the cylindrical portion 130. As best shown in FIG. 4, the counterbore 98 extends inwardly into the cylindrical portion 120 from the convex outer portion or surface 132.

In order to provide the desired downwardly and radially outwardly fan-shaped spray, the respective cylindrical bore portions 70 . . . 94 of the discharge ports 1 . . . 5 (66 . . . 90) are tangent to the circular concave face 122 at the juncture 124, as shown in FIG. 4. The bores 76 and 94 are both shown as tangent to the circular concave face 122 at the juncture 124. That is, the juncture 124 is tangent to the five circular bores of the five discharge ports or nozzles at the inner axial area or portion of each cylindrical bore. Accordingly, the distance between the longitudinal or center axis of the head 60 and the longitudinal axis of each of the five bores 70, 76, 82, 88, and 94, varies, with the distance measured radially, being minimum for the bore 70, and maximum for the bore 94. The radial distance between the longitudinal axis of the spray nozzle apparatus 10 and the axis of each of the cylindrical bore portions of the five discharge ports accordingly increases from a minimal radial distance for discharge port number 1 (nozzle 66) to a maximum radial distance for bore number 5 (nozzle 90). In each case, however, the cylindrical bore portion of each nozzle is tangent to the cylindrical concave face 122 at the juncture 124.

The circular concave face 122 curves continuously between the juncture 124 and the outer portion 126. The distance, arcuately, between the juncture 124 and the outer edge 126 is ninety degrees, and accordingly any plane which passes through the longitudinal axis of the nozzle apparatus 10 includes an arcuate segment of the circular concave face 122. The curved face 122 is cylindrically circular in that it extends for a full 360° about the head 60, and in that 360° area it is concave from a minimum diameter (or radius) from the juncture 124 to a maximum diameter (or radius) at the edge 122. The curved face 122 is regular in that the face 122 describes a circle or any plane which passes through the face 122 and which is perpendicular to the longitudinal axis of the head 60, and accordingly perpendicular to the longitudinal axis of the spray nozzle apparatus 10.

The convex outer or front portion 132 includes a pair of spaced apart and substantially parallel flats 134 and 138, best shown in FIG. 1. Between the flats and the outer cylindrical portion 130 are a pair of aligned shoulders 136 and 140. The purpose of the flats 134 and 138 is to allow a wrench to be inserted against the flats, and on the shoulders, in order to rotate the head 60 relative to the base 12 and to the gasket 40 to align the various discharge nozzle bores with the pipe P and its threaded bore 22. This allows the selection of any of the five varied outputs from the spray nozzle 10, as desired. With a wrench placed across the flats 134 and 138, the head 60 may be turned to align any of the notches 102 . . . 110 with the notch 30 for an output spray varying from a minimum from the nozzle or port number 1 (discharge nozzle or port 66) to a maximum with nozzle or port number 5 (discharge nozzle or port 90). If the notch 112 is aligned with the notch 30, no fluid or spray will be discharged from the head 60.

The use of "Teflon" for the material for the gasket 40 allows the head 60 to be rotated relative to the base 12 with a minimum of drag or frictional resistance, and yet still allows adequate sealing so as to prevent undesirable spray from emanating from the apparatus other than from a particular discharge nozzle or port. Moreover, the use of a self-locking nut 160 allows the apparatus to be adequately secured together, free from unnecessary bindings as the head is rotated relative to the base and gasket, and yet prevents the three major portions of the apparatus 10 from loosening during use.

Figure 6:
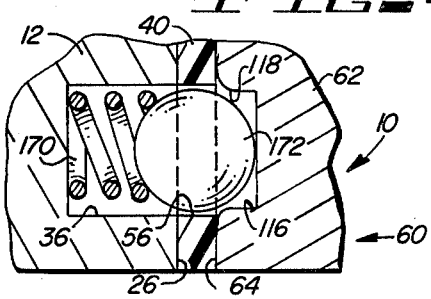
FIG. 6 is an enlarged view in partial section of a portion of the apparatus of the present invention, illustrating an alignment and locking detent and associated elements.

To insure that the head 62 does not vibrate or move relative to the base 12 and the gasket 40 in flight, a relatively simple detent and ball lock, such as illustrated in FIG. 6, may be provided, if desired. FIG. 6 comprises a view in partial section of the assembled nozzle apparatus 10, showing the base 12, the gasket 40, and the cylindrical portion 62 of the head 60. All three elements are located outwardly, radially speaking, with respect to the five discharge ports or nozzles 1 . . . 5.

The base 12 includes a bore 36 extending inwardly from the front face 26. The gasket 40 includes a hole or aperture 56 extending through the gasket 40 and aligned with the bore 36 when the base 12 and the gasket 40 are disposed against each other. The cylindrical portion 62 of the head 60 includes six relatively short bores 116 which extend inwardly from the rear face 64. The bores 116 are radially spaced so as to be aligned with the bore 36 and the hole or aperture 56 when the respective notches 102 . . . 112 are aligned with the notch 30.

Within the bore 36 is disposed a compression spring 170, which is biased against a ball 172. The ball 172 extends into the bore 116 from the bore 36, and through the hole or aperture 56. The ball 172 accordingly helps to lock together the base 12 and the head 60.

However, since the head 62 must move relative to the base 12, the bores 116 include chamfered shoulders 111 which act as cam surfaces when the head 60 is moved relative to the base 12 to cam the ball 172 out of the bore 116 and into the ball 36 and the hole 56, against the bias of the spring 170, to allow the head 60 to rotate until the next successive bore 116 is aligned with the ball 172 and the hole 56 and bore 36. At such time as the alignment is made, the ball 172, under the bias of the compression spring 170, moves into the bore 116. "Extra" effort is required to turn, initially, the base 60 due to the force required to cam the ball 172 out of the bore 116. The "extra" effort helps to insure that the head 60 remains in its desired location, with the appropriate nozzles and notches aligned, as desired.

The nozzle apparatus of the present invention allows a user to change flow rates easily and rapidly with a minimum of effort and tooling. With each delivery nozzle or flow rate there is provided a fan shaped spray as fluid impinges against the double curved surface of the spray head. While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Spray nozzle apparatus for providing a fan-shaped spray of liquid, comprising, in combination:

base means;

a first aperture extending through the base means for connecting to a flow of liquid to be sprayed;

spray head means rotatably secured to the base means including discharge nozzle means comprising a plurality of discharge nozzles spaced apart from each other and selectively alignable with the first aperture of the base means for receiving a flow of liquid to be sprayed, a circular concave face adjacent the discharge nozzle means against which the liquid flows from a discharge nozzle selectively aligned with the first aperture, and each discharge nozzle of the plurality of discharge nozzles is tangent to the circular concave face to provide a fan-shaped spray of the liquid when aligned with the first aperture.

2. The apparatus of claim 1 in which each discharge nozzle of the discharge nozzle means includes a tapered bore portion and a cylindrical bore portion, and the cylindrical bore portions are disposed adjacent the circular concave face.

3. The apparatus of claim 2 in which the cylindrical bore portions of the discharge nozzle means are each of a different diameter for providing a different flow of liquid spray from each discharge nozzle as it is selectively aligned with the first aperture of the base means.

4. The apparatus of claim 3 in which the base means includes a second aperture extending through the base means and spaced apart from the first aperture and comprising a cleanout aperture, and the discharge nozzles are selectively aligned with the second aperture for cleaning.

5. The apparatus of claim 4 in which the base means further includes a gasket disposed against the spray head means, and the gasket includes a first aperture aligned with the first aperture of the base means and a second aperture aligned with the second aperture of the base means.

6. The apparatus of claim 3 in which the base means includes an indexing notch oriented in a predetermined nanner with respect to the first aperture, and the discharge nozzle means includes a notch for each discharge nozzle for aligning the discharge nozzles selectively with the first aperture of the base means by alignment of the indexing notch of the base means with one of the notches of the base means.

7. The apparatus of claim 3 in which the spray head means further includes a cylindrical portion, a rear face disposed against the base means, and a front face disposed adjacent the circular concave face.

8. The apparatus of claim 6 in which the circular concave face of the spray head means includes a minimum diameter portion at the front face of the cylindrical portion and the cylindrical bores are tangent to the circular concave face at the minimum diameter portion.

9. The apparatus of claim 8 in which the base means further includes a front face and a gasket disposed between the front face of the base means and the rear face of the spray head means.

10. The apparatus of claim 9 in which the gasket of the base means includes a first aperture and a second aperture aligned respectively with the first and second apertures of the base means.

* * * * *